US005528786A

United States Patent [19]

Porat et al.

[11] Patent Number: 5,528,786

[45] Date of Patent: Jun. 25, 1996

[54] TOOTHBRUSHES

[76] Inventors: Amir Porat, P.O. Box 6462, Ganei-Yehuda 56905; Adam Waks, 6 Ravutzki Street, Ra'anana 43221, both of Israel

[21] Appl. No.: 439,135

[22] Filed: May 11, 1995

[30] Foreign Application Priority Data

May 11, 1994 [IL] Israel ..... 109622

[51] Int. Cl.[6] ..... A46B 7/06

[52] U.S. Cl. ..... 15/22.1; 15/167.1; 15/201

[58] Field of Search ..... 15/22.1, 22.2, 15/167.1, 201; 433/216

[56] References Cited

U.S. PATENT DOCUMENTS

| | | | |
|---|---|---|---|
| 5,120,225 | 6/1992 | Amit | 433/216 |
| 5,186,627 | 2/1993 | Amit | 15/22.1 |

FOREIGN PATENT DOCUMENTS

| | | | |
|---|---|---|---|
| 1166163 | 6/1958 | France | 15/22.1 |
| 2616306 | 12/1988 | France . | |
| 1805982 | 10/1968 | Germany | 15/22.1 |
| 294298 | 6/1954 | Switzerland | 15/22.1 |
| 92/17094 | 10/1992 | WIPO . | |

*Primary Examiner*—Edward L. Roberts, Jr.
*Attorney, Agent, or Firm*—Helfgott & Karas

[57] ABSTRACT

A toothbrush comprising an elongated handle, a bristle support member articulately mounted on one end of the handle so as to be constrained, in use, into limited reciprocal movement with respect to the handle and in a direction of longitudinal axis of the handle. The toothbrush further comprising a plurality of bristle tuft arrays pivotally mounted on the support member about at least one pivotal axis substantially parallel to the longitudinal axis and articulately coupled to the one end of the handle so that the limited reciprocal movement of the support member gives rise to limited pivotal lateral rocking of the bristle arrays.

19 Claims, 4 Drawing Sheets

TOOTHBRUSHES

FIELD OF THE INVENTION

The present invention relates to toothbrushes.

BACKGROUND OF THE INVENTION

It has long been realized that correct teeth brushing plays a great role in ensuring the health of the teeth and gums.

It is now generally recommended that brushing be performed with up and down strokes which ensures maximal penetration of the bristles between the teeth thereby ensuring efficient removal of plaque from the teeth's surface and food remains from in between teeth and from the function of the teeth and the gums, thereby minimizing dental diseases, e.g. tooth decay or gum inflammations.

However, this recommended practice is somewhat awkward and does not conform with a normal tendency to carry out brushing in a direction essentially parallel with that of a standard toothbrush's longitudinal axis, e.g. across the teeth's surface.

Heretofore various proposals have been made and in some cases put into practice for obtaining efficient and correct teeth brushing. Among these are a variety of brushes equipped with electric motors which give rise to reciprocal angular displacement of the entire head of a toothbrush with respect to its longitudinal axis. However, these are somewhat cumbersome devices and relatively expensive and have not been generally accepted by the public.

Various proposals for manually operated toothbrushes have also been made, among which is the disclosure of U.S. Pat. No. 4,269,038 (Bradley), according to which the head portion of a toothbrush incorporates two pairs of elongated bristle carrying pads with the pad of each pair positioned side-by-side and the pairs end-to-end. Each such pad is hinged to the head portion of the toothbrush with a hinge axis being angularly disposed with respect to the elongated axis of the brush. The hinge is made of a resilient material, permitting tilting of the bristle-holding pads along said angular disposed axis, whereby, an up-down stroking action is obtained in concert with a side-to-side stroke along the teeth.

French Patent No. 2,616,306 (Bois) discloses a toothbrush having at its head portion an S-shaped recess pivotally accommodating two crescent-shaped bristle-holding pads, adapted for angular reciprocation within said recess and in the plane of the brush's head, whereby, only a planar motion of the moving bristles is obtained.

However, a disadvantage of the hitherto proposed toothbrushes is that the moving bristle pads reciprocate in a direction which is not perpendicular with respect to the longitudinal axis of the brash, thus, the correct and recommended practice of teethbrushing is not obtained. Another disadvantage is that reciprocal movement of the reciprocating bristle pad is obtained only by linear reciprocation of the brush along its longitudinal axis, including its integral head portion, thus, although there is some lateral displacement of the bristles, however, it occurs along the route of linear reciprocation, i.e., it is not possible to perform actual up and down brushing of a specific group of teeth, as the entire brush must be continuously linearly reciprocated.

It is an object of the present invention to provide a new and improved toothbrush that significantly reduces the above-identified disadvantages.

BRIEF SUMMARY OF THE INVENTION

According to the invention there is provided a toothbrush comprising an elongated handle; a bristle support member articulately mounted on one end of said handle so as to be constrained, in use, into limited reciprocal movement with respect to the handle and in a direction of longitudinal axis of the handle; a plurality of bristle tuft arrays pivotally mounted on said support member about at least one pivotal axis substantially parallel to said longitudinal axis and articulately coupled to said one end of said handle so that said limited reciprocal movement of said support member gives rise to limited pivotal lateral rocking of said bristle arrays.

Preferably, the toothbrush comprises at least one additional bristle tuft array fixedly mounted on said support member which fixed bristles are slightly more rigid and they extend slightly beyond the tips of said pivotally mounted bristles.

Also preferably, the additional bristle tuft arrays and the pivotal bristle tuft arrays alternate with each other, and the pivotally mounted arrays are articulately coupled to said one end of said handle by means of a cam and cam follower arrangement.

In accordance with one embodiment of the invention, said one end of said handle is formed on a top surface thereof with at least one cam groove and said bristle support member comprises adjacent at least one of its longitudinal side edges at least one rocking bar bearing said bristle tuft array and being pivotally mounted thereon; said rocking bar is provided with a downward projecting follower pin adapted for engagement with said cam groove. It should be appreciated that said at least one cam groove may be of any desired such as, for example, an arc or a wavelike shape.

According to a preferred configuration of this embodiment, the toothbrush comprises two central rows of fixedly mounted bristle tufts and one row of bristle tufts on each of two or more rocking bars, and said pivotally mounted bristle tuft arrays are substantially as long as said fixedly mounted arrays of bristle tufts.

In accordance with a second embodiment of the invention, said one end of said handle is formed on its top surface adjacent its longitudinal edges with upright cam members, where the elevated cam portions on one side alternate with the elevated cam members on the other side; each of said pivotally mounted arrays is mounted on a rocker member formed with a bottom surface constructed or two inclined follower surfaces adapted for sliding engagement with said upright cam members; the arrangement being such that when one of said inclined follower surfaces engages an upright cam member, the other inclined follower surface becomes flush or indented with respect to a bottom surface of said bristle support member.

According to a preferred configuration of this embodiment, said pivotally mounted bristle tuft arrays have a width substantially equal to that of said fixedly mounted bristle tuft arrays and said reciprocal movement of said support member is limited by a downward projecting stud slidingly engaging a groove parallel with said longitudinal axis; the groove having a length corresponding to a stroke of said support member.

BRIEF DESCRIPTION OF THE DRAWINGS

For a better understanding, the invention will now be described, by way of example only, with reference to the accompanying drawings, in which.

DETAILED DESCRIPTION OF PREFERRED EMBODIMENTS

Figure 1A:
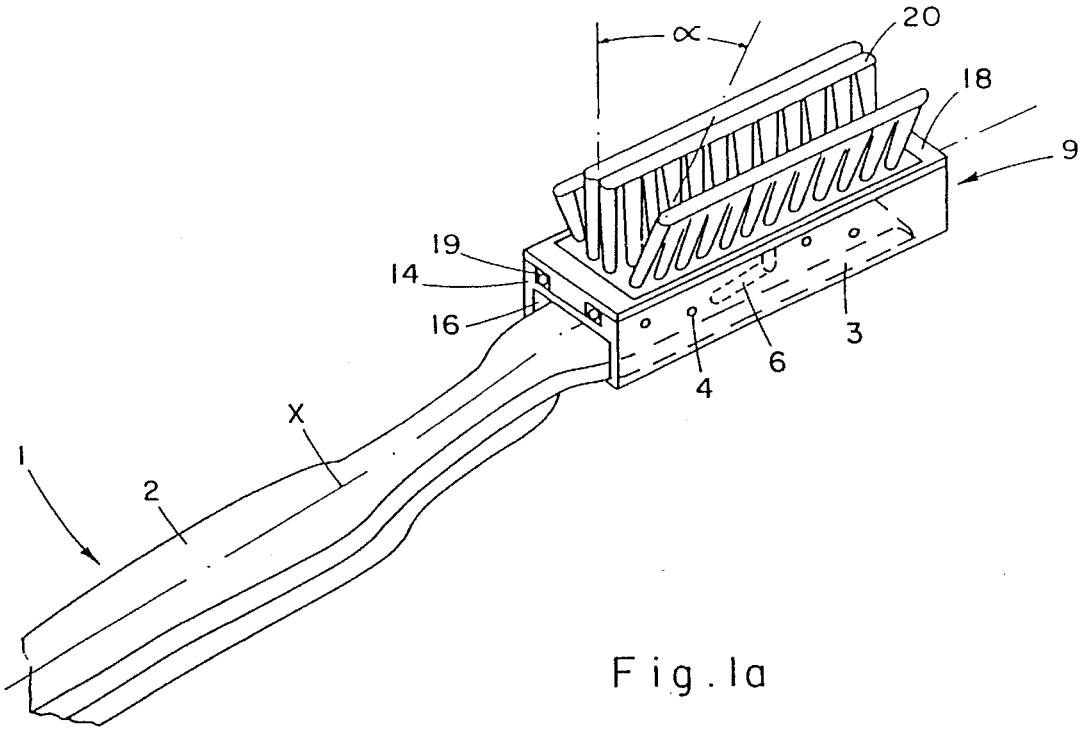
FIGS. 1*a* and 1*b* are isometric views, partially cut-out, of a toothbrush according to one embodiment of the invention, the pivotal arrays shown in their angularly disposed and in their joint positions, respectively.
Figure 1B:
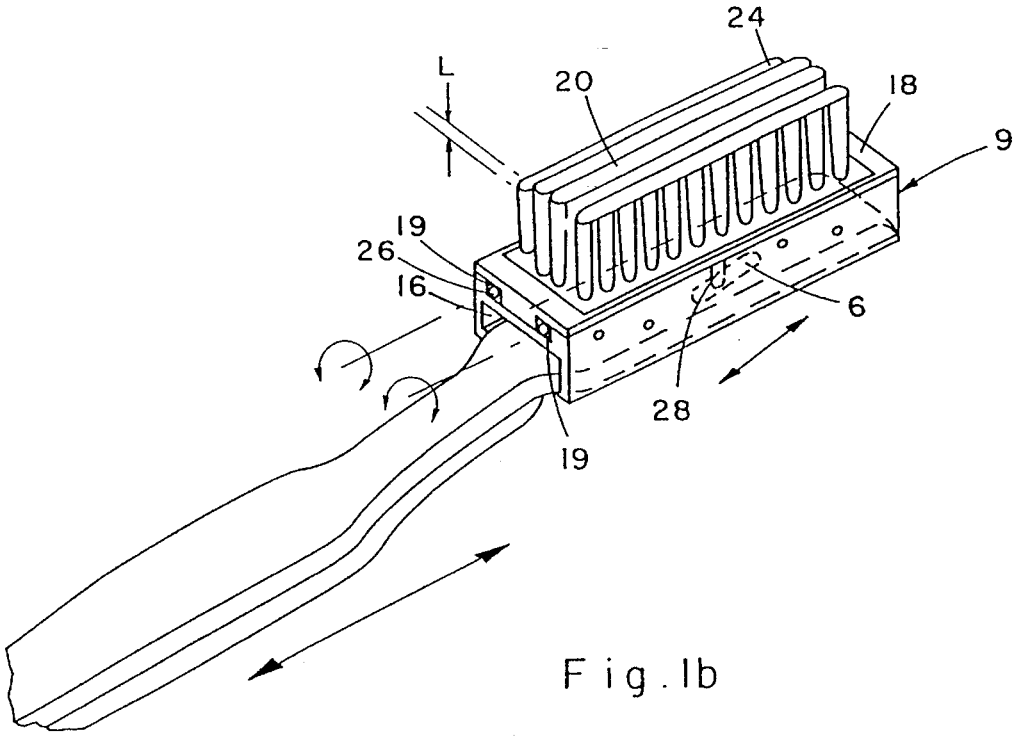
Figure 2:
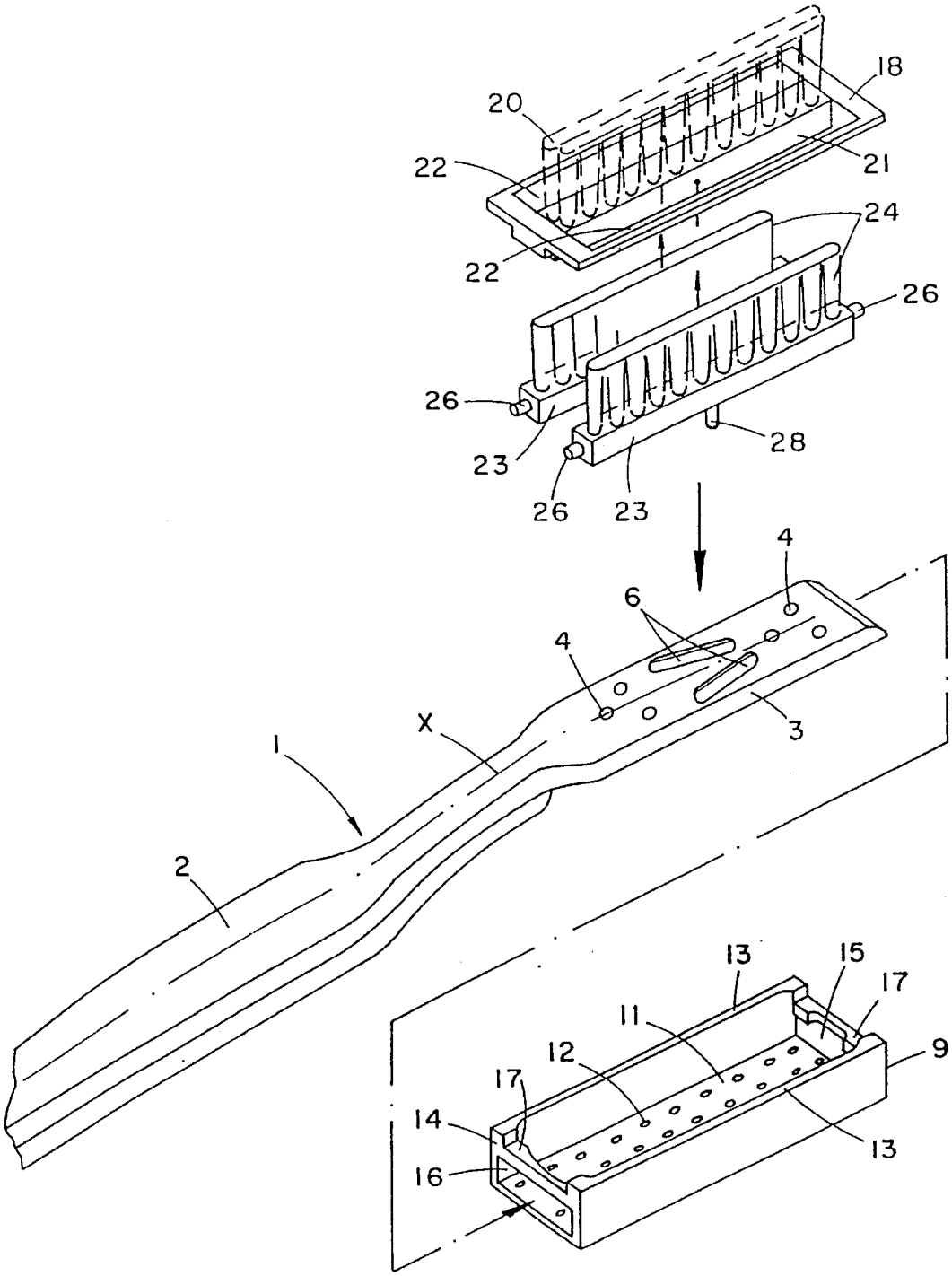
FIG. 2 is a perspective exploded view showing in detail the constituent elements of the toothbrush of FIGS. 1*a* and 1*b;*

Reference is first being made to FIGS. 1*a*, 1*b* and 2 of the drawings in which a first embodiment of a toothbrush according to the present invention consists of an elongated handle generally designated 1 having a longitudinal axis X and having a handle portion 2 and an integral flat head portion 3. The head portion 3 has a plurality of draining apertures 4 and two grooves 6 sloping towards said longitudinal axis X.

A box-like bristle support member 9 has a bottom face 11 with a plurality of holes 12, two side walls 13, and two end walls 14 and 15 extending lower than the side walls 13. Each wall 14 is further provided with a rectangular opening 16. A top cover 18 (of the box-like member 9) has mounted thereon a fixed array of bristles 20 which in the particular embodiment consists of two rows of bristle tufts 20 mounted on a central stem 21. The latter has a thickness and width such that it defines together with the inner faces of the side walls 13 and the top edge of the end wall 14 a pair of elongated sockets 19. The top cover 18 furthermore has pined adjacent its longitudinal edges, two elongate slots 22.

Two rocking bars 23 have each mounted thereon an array of bristles 24 consisting of a row of bristle tufts 24 and are provided with an axial hinge 26 at each end and a downward projecting stud 28 suitable for sliding engagements with grooves 6 of the head portion 3. The studs 28 and the grooves 6 together constitute a cam and cam follower arrangement, As seen in FIGS. 1*a* and 1*b* the rocking bars 23 are pivotally mounted within the bristle support member 9 with their axial hinges 26 received within the sockets 19. The rocking bars 23 are pivotal in an axis substantially parallel to the longitudinal axis X of the toothbrush.

As can be seen in the drawings, the rectangular opening 16 has a width suitable for slidingly accommodating the head portion 3 of the handle 1 with the studs 28 engaging in the grooves 6 and in this way the bristle support member 9 is articulately mounted on the handle 1 so as to be capable of limited reciprocating motion along the longitudinal axis X with respect, the reciprocating stroke being limited by the extent of the grooves 6.

In operation, the user gently presses the fixed bristles 20 against his teeth and reciprocates the handle 1 along its longitudinal axis X. As a result of the friction between the fixed bristles 20 and the teeth, the bristle support member reciprocates along the handle and the rocking bars 23 are constrained to rock about their longitudinal axis, parallel to the longitudinal axis X, resulting in up and down strokes of the pivotal tuft arrays. If, however, the user reciprocates the handle 1 with strokes longer than the length of grooves 6, then the bristle support member 9 will reciprocate along the width of handle 1, with the rocking bars 23 still constrained to rock as explained above.

As can be seen from FIG. 1*b*, in order to improve functional contact of the fixed bristle tufts 19 with the teeth, these bristles are made slightly longer and more rigid than those of the pivotal arrays.

It was found that a height difference L between the fixed and pivotal bristles ranging between 0.5 to 2 mm, together with a tilting angle $\alpha$ (see FIG. 1*a*) in the range of $-5°$ to $+20°$, obtained best results.

The draining apertures 4 together with the holes 12 serve for rinsing toothpaste etc., so as to prevent accumulation thereof in the grooves 6 and between the bristle support member 9 and the head portion 3, in order to prevent jamming.

Figure 3A:
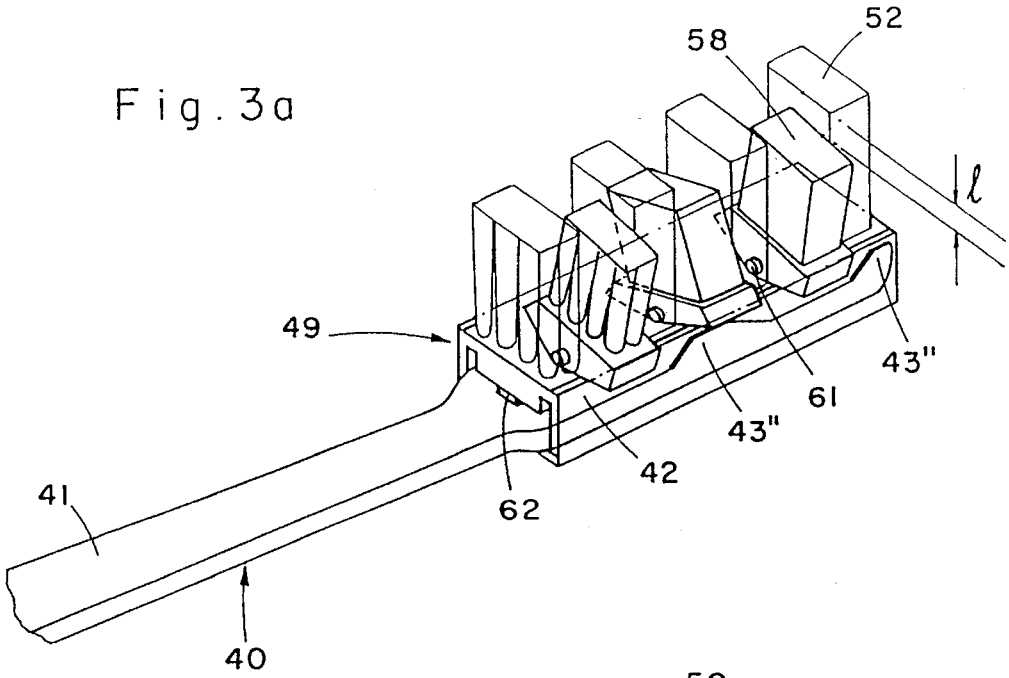
FIGS. 3*a* and 3*b* are isometric views, partially cut-out, of a toothbrush according to another embodiment of the invention in first and second angularly disposed positions, respectively.
Figure 3B:
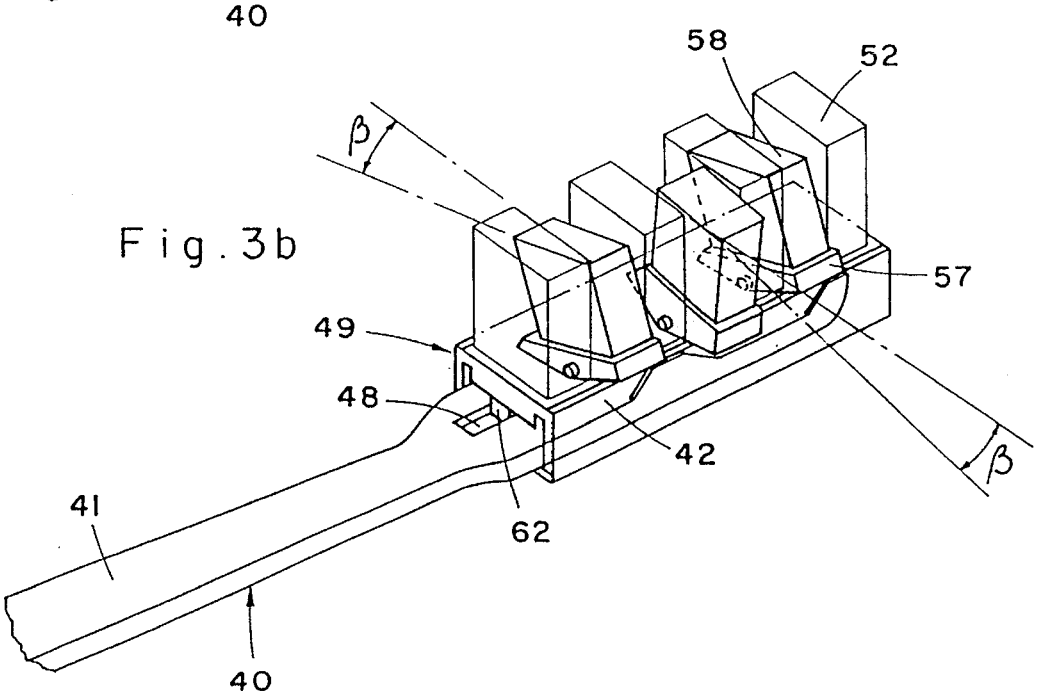
Figure 4:
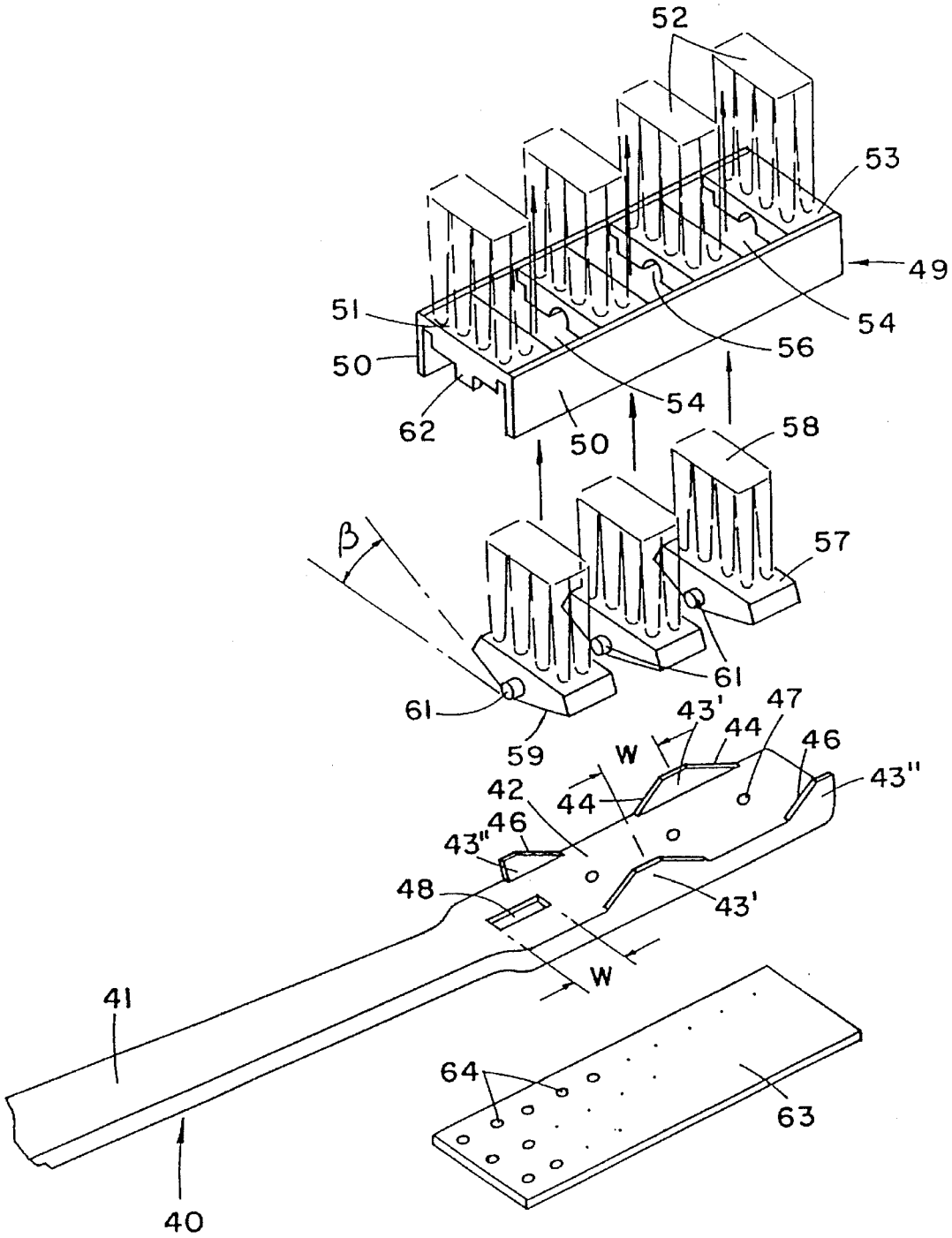
FIG. 4 is a perspective, exploded view showing the constituent elements to of the toothbrush of FIGS. 3*a* and 3*b*.

Reference is now made to FIGS. 3*a*, 3*b* and 4 of the drawings in which a second embodiment of the present invention is illustrated. In this embodiment and similar to the first embodiment an elongate handle generally designated 40 has an elongated longitudinal axis and a handle portion 41 and a head portion 42.

As seen in FIG. 4, the head portion 42 has pined on a top surface thereof a plurality of upright cam members 43' and 43" flush with the side walls of the head portion 42. The arrangement is such that the elevated cam members on one side alternate with the elevated cam members on the other side. First cam members 43' located opposite the spaces between second cam members 43" have each two ramped gliding surfaces 44 whereas the second members 43" each have only one ramped gliding surface 46. The head portion 42 further comprises a plurality of draining apertures 47 and a groove 48 parallel with the longitudinal axis X.

A bristle support member 49 has an essentially U-shaped cross-section having two side walls 50 and a top surface 51 on which are mounted four fixed bristle tuft arrays 52 fixed on bridging members 53 with spacing 54 therebetween. Each bridging member 53 has on a side facing a neighboring bridging member, a recess 56.

Each spacing 54 is adapted for receiving a rocking member 57 on which is mounted on a top surface thereof a bristle tuft array 58. The rocking member 57 has a triangular shaped base 59, the two inclined surfaces thereof serving as cam followers which together with cams 43' and 43" constitute a cam and cam follower arrangement. Each rocking member 57 further comprises two aligned, lateral projecting hinges 61, adapted for pivotal mounting within said spacings 54, with the hinges 61 resting within the recess 56.

At the rear edge of the bristle support member 49 there is a downward projecting stud 62 adapted for reciprocating within groove 48 of the head portion 42, serving together as a reciprocation limit. A bottom plate 63 is fixedly assembled to the bristles support member 49, and has a plurality of holes 64 which together with draining holes 47 of head portion 42 serve for rinsing the toothbrush from excessive toothpaste, etc.

In operation, the user gently presses the bristles against his teeth and reciprocates the handle 41 along its longitudinal axis X. Each time a cam surface 59 encounters a cam member 43' or 43" it ascends over the gliding ramp 45 or 46 respectively, and tilts over to the other side as illustrated in FIGS. 3*a* and 3*b*. In this position, when the bristle support member 49 has the fixed bristle tuft arrays 52 in functional contact with the teeth wherein the bottom plate 63 contacts the inner cheek, the bristle support member 49 may remain static but the pivotal bristle tuft arrays 58 will rock up and down. However, if the user reciprocates the handle 41 with strokes longer than the length of groove 48, then, the bristle support member 49 will reciprocate along with the handle 41, with the rocking members 57 continuing to rock as explained above.

Also according to this embodiment, in order to improve contact of the fixed arrays of bristle tufts 52 with the teeth, these bristles are made slightly longer and more rigid than the pivotal array of bristle tufts 58 as seen in FIG. 3*a*.

According to a preferred modification of this embodiment, the length of groove 48 is such that each axial stroke causes each rocking member 57 to rock only once at each stroke. However, if the distance between adjacent cam members 43' and 43" decreases, each rocking member 57 will rock more than once at each stroke.

It was found that for this particular embodiment, a height difference L between the fixed and pivotal bristles ranging between 0.5 and 2 mm, and a tilting angle β (see FIG. 3*b*) in the range of 5° to 20°, obtained best results.

The number and order of the fixed and pivotal bristle tuft arrays may vary as desired. Furthermore, the tilting angle and the height difference L may be of dimensions other than those specified. Additionally, the fixed and pivotal bristle arrays of the toothbrush may each be of different rigidity.

What is claimed is:

1. A toothbrush comprising an elongated handle; a bristle support member articulately mounted on one end of said handle so as to be constrained, in use, into limited reciprocal movement with respect to the handle and in a direction of longitudinal axis of the handle; a plurality of bristle tuft arrays pivotally mounted on said support member about at least one pivotal axis substantially parallel to said longitudinal axis and articulately coupled to said one end of said handle.

2. A toothbrush according to claim 1, further comprising at least one additional bristle tuft array having bristles, the at least one additional bristle tuft array fixedly mounted on said support member.

3. A toothbrush according to claim 2, wherein the bristles of said additional bristle tuft array(s) extend slightly beyond the tips of said pivotally mounted arrays.

4. A toothbrush according to claim 3, wherein the bristles of said additional bristle tuft array(s) are slightly more rigid than those of the pivotally mounted arrays.

5. A toothbrush according to claim 2, wherein the bristles of said additional bristle tuft array(s) are slightly more rigid than those of the pivotally mounted arrays.

6. A toothbrush according to claim 2, wherein said additional bristle tuft array(s) and said pivotal bristle tuft arrays alternate with each other.

7. A toothbrush according to claim 2, wherein said one end of said handle is formed on a top surface thereof with at least one cam groove formed along said longitudinal axis of said handle and said bristle support member comprises adjacent at least one of its longitudinal side edges at least one rocking bar bearing said bristle tuft array and being pivotally mounted thereon, said rocking bar being provided with a downward projecting follower pin adapted for engagement with said cam groove so that said limited reciprocal movement of said support member gives rise to limited pivotal lateral rocking of said bristle arrays.

8. A toothbrush according to claim 7, wherein said at least one cam groove slopes toward said longitudinal axis.

9. A toothbrush according to claim 7, wherein said at least one cam groove is arced or undulatory along an axis parallel to said longitudinal axis.

10. A toothbrush according to claim 7, comprising adjacent each of its longitudinal side edges two or more consecutive rocking bars having a common axis parallel to said longitudinal axis.

11. A toothbrush according to claim 10, comprising two central rows of fixedly mounted bristle tufts and one row of bristle tufts on each of said rocking bars.

12. A toothbrush according to claim 2, wherein said one end of said handle is formed on a top surface thereof adjacent longitudinal edges with upright cam members, where the upright cam members on one side alternate with the upright cam members on the other side; each of said pivotally mounted arrays being mounted on a rocker member formed with a bottom surface constructed of two symmetrically inclined follower surfaces adapted for sliding engagement with said upright cam members; the arrangement being such that when one of said inclined follower surfaces is engaged with one of said upright cam members, the other inclined follower surface is flush or indented with respect to a bottom surface of said bristle support member.

13. A toothbrush according to claim 1, wherein said pivotally mounted arrays are articulately coupled to a cam and cam follower assembly on said one end of said handle, the assembly having a cam groove formed on said one end of said handle, the groove arranged to engagingly accept a projecting stud.

14. A toothbrush according to claim 1, wherein said one end of said handle and said bristle support member comprise apertures for use in rinsing.

15. A toothbrush according to claim 14, wherein said pivotally mounted bristle tuft arrays are substantially as long as bristle tuft arrays fixedly mounted on said support member.

16. A toothbrush according to claim 15, wherein said pivotally mounted bristle tuft arrays have a width substantially equal with that of said fixedly mounted bristle tuft arrays.

17. A toothbrush according to claim 15, wherein said reciprocal movement of said support member is limited by a downward projecting stud slidingly engaging a groove formed in said one end of said handle parallel to said longitudinal axis, the groove having a length corresponding to a stroke of said support member.

18. A toothbrush according to claim 15, comprising 3 pivotal bristle tuft arrays and 4 fixed bristle tuft arrays alternating with one another.

19. A toothbrush according to claim 15, comprising 4 pivotal bristle tuft arrays and 3 fixed bristle tuft arrays.

* * * * *